US008997408B2

(12) United States Patent
Borra

(10) Patent No.: US 8,997,408 B2
(45) Date of Patent: Apr. 7, 2015

(54) ROOF PROVIDED WITH AN ANCHOR SYSTEM

(75) Inventor: Hans Antonius Borra, Zeist (NL)

(73) Assignee: Flesst B.V., Harde (NL)

( * ) Notice: Subject to any disclaimer, the term of this patent is extended or adjusted under 35 U.S.C. 154(b) by 0 days.

(21) Appl. No.: 13/881,845

(22) PCT Filed: Oct. 28, 2011

(86) PCT No.: PCT/EP2011/069038
§ 371 (c)(1),
(2), (4) Date: Aug. 13, 2013

(87) PCT Pub. No.: WO2012/056020

PCT Pub. Date: May 3, 2012

(65) Prior Publication Data

US 2014/0144089 A1 May 29, 2014

(30) Foreign Application Priority Data

Oct. 29, 2010 (EP) ..... 10189428

(51) Int. Cl.
*E04G 21/32* (2006.01)
*E04B 1/38* (2006.01)
(Continued)

(52) U.S. Cl.
CPC ..... *E04G 21/3214* (2013.01); *E04D 13/12* (2013.01); *E04G 21/3276* (2013.01); *E04G 21/3295* (2013.01); *E04D 13/174* (2013.01)

(58) Field of Classification Search
CPC ... E04G 21/3261; E04G 3/26; E04G 21/3214; E04G 21/3276; E04G 3/28; E04G 21/3223; E04G 21/3295; E04G 5/041; E04D 13/12; E04B 7/045; E04B 1/38; E04B 1/2608; E04B 1/2604; E04B 1/2612; E04B 1/344; E04B 2001/2684; A62B 35/0056; A62B 35/0062; A62B 35/0068; A62B 35/0075
USPC ..... 52/23, 24, 27, 4–5, 43–44, 155, 90.2, 52/90.1, 57, 42, 94–97, DIG. 12, 698; 182/3, 4, 8–9, 36, 45, 231
See application file for complete search history.

(56) References Cited

U.S. PATENT DOCUMENTS 5,287,944 A 2/1994 Woodyard
5,326,318 A * 7/1994 Rotter ..... 454/365
(Continued)

FOREIGN PATENT DOCUMENTS

AU 684452 12/1997
DE 202007003875 5/2007
(Continued)

OTHER PUBLICATIONS

European Search Report and Written Opinion of the European Patent Office Patent Office in counterpart foreign application PCT/EP2011/069038 filed Oct. 28, 2011.
(Continued)

*Primary Examiner* — Jeanette E Chapman
(74) *Attorney, Agent, or Firm* — Steven M. Koehler; Westman, Champlin & Koehler, P.A.

(57) ABSTRACT

Aspects of the invention relate to a roof comprising at least an inclined surface and a rim marking a transition to another surface extending horizontally or at a different inclination, the inclined surface and the rim being covered by roof elements. The roof further comprising at least one anchor for attaching an anchor rope to. The anchor is secured to the roof beneath the roof element or elements covering the rim and the roof elements covering the rim are spaced apart from the roof elements covering the inclined surface so as to allow access to the anchor from outside the roof.

11 Claims, 3 Drawing Sheets

(51) Int. Cl.

| | |
|---|---|
| ***E04D 13/12*** | (2006.01) |
| ***E04D 13/17*** | (2006.01) |
| *A62B 35/00* | (2006.01) |

(56) References Cited

U.S. PATENT DOCUMENTS

| | | | | |
|---|---|---|---|---|
| 5,361,558 | A | 11/1994 | Thornton | |
| 5,581,955 | A * | 12/1996 | Gleave | 52/27 |
| 5,636,704 | A | 6/1997 | Castaneda | |
| 5,829,200 | A * | 11/1998 | Jones et al. | 52/3 |
| 5,878,534 | A * | 3/1999 | Gleave | 52/27 |
| 5,896,719 | A | 4/1999 | Thornton | |
| 6,553,739 | B2 * | 4/2003 | Richardson | 52/208 |
| 2004/0007150 | A1 | 1/2004 | Gleave | |
| 2006/0260260 | A1 * | 11/2006 | Blackford | 52/698 |
| 2010/0006373 | A1 | 1/2010 | Bodnar | |
| 2010/0133040 | A1 | 6/2010 | London | |

FOREIGN PATENT DOCUMENTS

| | | |
|---|---|---|
| EP | 0593150 | 4/1994 |
| WO | WO 02/44496 | 6/2002 |
| WO | WO 2005/098166 | 10/2005 |

OTHER PUBLICATIONS

"Kingspan Saferidge Systems", Dec. 2008, Kingspan Ltd.

* cited by examiner

ROOF PROVIDED WITH AN ANCHOR SYSTEM

CROSS-REFERENCE TO RELATED APPLICATION

The present application is a national stage filing of International patent application Serial No. PCT/EP2011/069038, filed Oct. 28, 2011, and published as WO 2012/056020 A1 in English.

BACKGROUND

The discussion below is merely provided for general background information and is not intended to be used as an aid in determining the scope of the claimed subject matter.

Aspects of the invention relate to a roof comprising at least an inclined surface and a rim marking a transition to another surface extending horizontally or at a different inclination, the inclined surface and the rim being covered by roof elements, such as tiles, slates, shingles, or (metal) covers, the roof further comprising at least one anchor for attaching a rope to. Aspects of the invention also relate to an anchor system to be installed on a roof.

Known systems require a large number of operations, in particular temporarily removing tiles and repeatedly securing a rope to and releasing it from the belts. Further, in some countries, the law nowadays stipulates that roof elements be permanently fixed to the roof. As a side effect, this prevents workers from temporarily removing such elements to reach an anchor system underneath.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background. An aspect of the invention includes an improved system for use on roofs comprising an inclined surface and covered by roof elements, in particular a system that can be installed permanently and yet requires no significant visual alterations to the roof.

In an embodiment, at least one anchor is secured to the roof beneath the roof element or elements covering the rim and in that the roof elements covering the rim are spaced apart from the roof elements on the inclined surface to allow access to the anchor from outside the roof.

The system employs the space between e.g. ridge tiles and the ridge beam to install an anchor system. As a result, the anchor system is practically hidden from view and has little or no impact on the appearance of the roof. Also, no roof elements need to be removed to reach the anchor system.

In a particularly practical embodiment, a longitudinal guide, such as a rail or wire, is secured to the roof beneath the roof elements covering the rim and the at least one anchor is slidably secured to, in, or about the guide. Thus, when a worker attaches himself to a rope that in turn is attached to the anchor, the anchor will slide along with, i.e. follow the worker. Put differently, the point where the rope is attached to the system will follow the worker and be located directly above him or nearly so, avoiding or reducing, in case of a fall, any pendulum effect. In combination with a slidable carabine, rope adjuster, or rope grab device, the rope can be kept taut (pulled tight) at all times, practically reducing the fall factor to zero or close to zero. The fall factor is defined as the ratio of the length a climber or worker falls before his rope begins to stretch and the amount of rope available to absorb the energy of the fall. The lower the fall factor, the lower the risk of trauma or (other) injury.

Also, with the sliding anchor, there is no need for the worker to switch from one anchor to the next nor is there any need for wearing a Y-harness.

In a further aspect, the anchor is secured, directly or via the guide, to one or more structural elements of the roof, such as to a ridge beam, a sideboard, or to and/or across rafters or purlins, providing ample and durable strength when a worker fastens himself to the anchor.

If the guide comprises at least two rails, with an anchor slidably secured to, in or about each of the rails and on either side of the rim, the anchor system can be used on either side of e.g. the apex of a roof.

In a further aspect, the guide comprises an extrusion profile defining the rail or rails. Such profiles provide good mechanical strength and allow the integration of one or more additional features, such as a ridge beam and/or means for attaching a ventilated ridge element to the guide. Fixing the roof element or elements covering the rim (directly) to the guide facilitates more efficient use of the space beneath these roof elements.

An aspect of the invention further relates to an anchor system to be installed on a roof comprising at least an inclined surface and a rim marking a transition to another surface extending horizontally or at a different inclination, the surfaces and rim being covered by roof elements, the system comprising an extrusion profile to be secured beneath the roof elements covering the rim and defining a guiding rail or rails, and one or more anchors to be slidably secured to, in, or about the rail or rails.

In an embodiment, the extrusion profile further defines a ridge beam and/or means for attaching a ventilated ridge element.

The system can be installed in new buildings or it can be retrofitted on existing buildings. It can be delivered as a kit comprising, in addition to the profile and the at least one anchor, a written instruction to install the profile in the space beneath the roof elements covering the rim, e.g. fasten the profile to the ridge beam or ridge beam supports.

In an embodiment, the extrusion profile further defines means for fixing the roof element or elements covering the rim (directly) to the guide, e.g. to the topside of the guide between two rails. Examples of such means include a slot running the length of the profile or holes for fastening screws, bolts, plugs or the like.

Within the framework of the present invention "inclined surface" includes surfaces having an inclination of 90°, i.e. that are vertical. "Slidably secured" includes any mechanism that allows secure translation of the anchor along the guide. "Anchor rope" refers to any long, thin and flexible element that is suitable for securing a person to an anchor on a roof as described above. Examples include cords, lifelines, lanyards, and non-textile elements such as chains, e.g. plastic-coated chains.

BRIEF DESCRIPTION OF THE DRAWINGS

Aspects of the invention will now be explained in more detail with reference to the Figures, which show embodiments of the present roof and anchor system.

DETAILED DESCRIPTION OF THE ILLUSTRATIVE EMBODIMENTS

Figure 1:
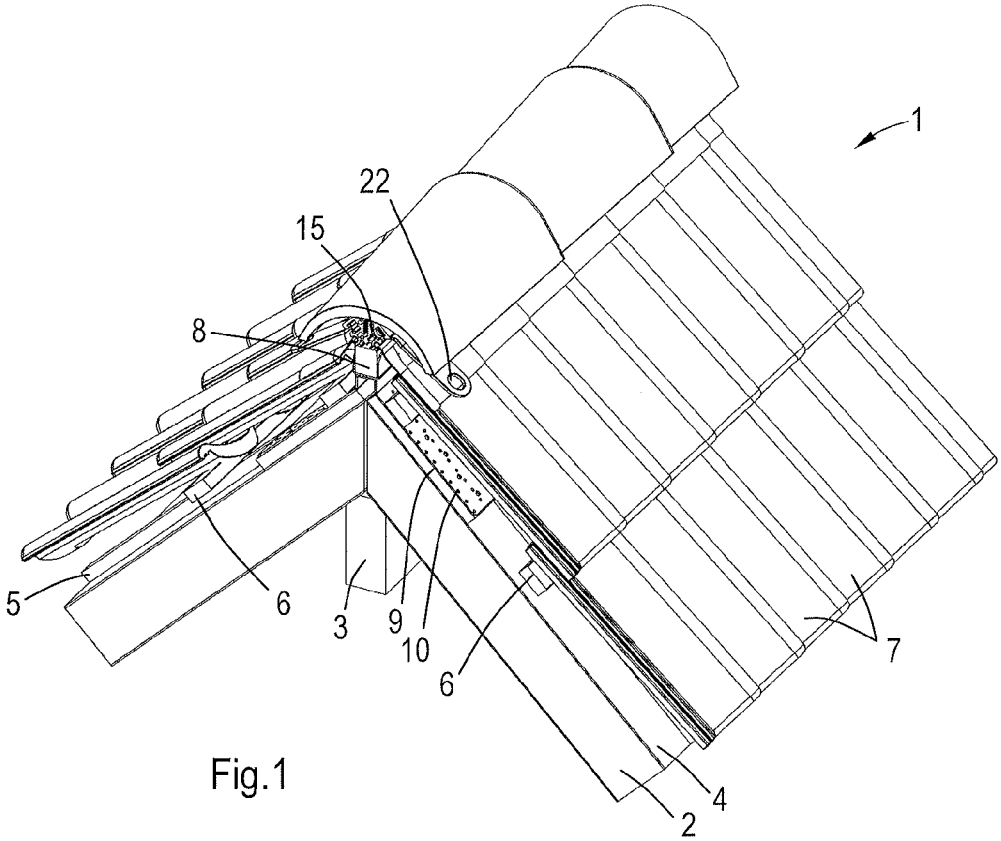
FIG. 1 is a perspective view of a saddle roof comprising a wooden ridge beam and an anchor system.
Figure 2:
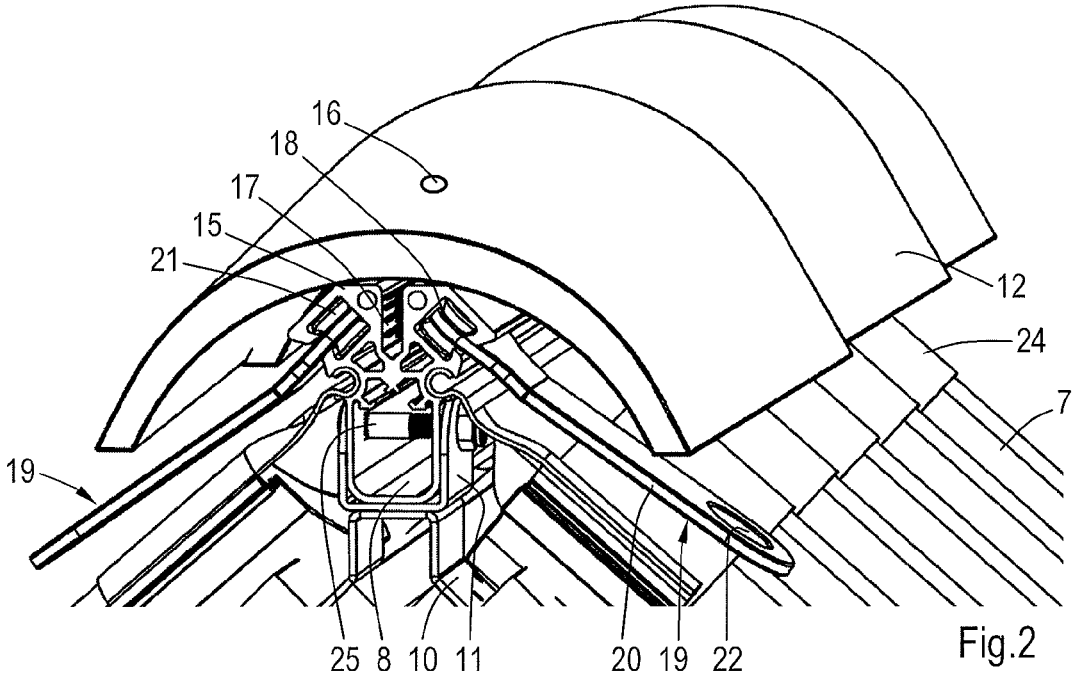
FIG. 2 is a perspective view of a saddle roof comprising a metal ridge beam integrated in the anchor system.

FIGS. 1 and 2 show a saddle roof 1 comprising structural elements, in particular rafters 2 and a main beam 3, and roof slabs 4 fixed, e.g. nailed, to the rafters 2. Vertical battens 5 are fixed to the roof slabs 4 and horizontal battens 6 are fixed to the vertical battens 5 at some distance from the roof slabs to allow dirt and water to flow downwards and to improve ventilation. Rows of roof tiles 7 are supported on the horizontal battens 6.

A ridge beam 8 is mounted at the apex of the roof 1 via ridge beam supports 9. These supports comprise downwardly diverging legs 10 to fix the supports to the roof slabs 4 and parallel legs 11 extending upwards to receive the ridge beam 8. Ridge tiles 12 are positioned over the ridge beam 8 to protect it from wind and rain and to prevent water from entering the space between the roof tiles and the roof slabs.

A longitudinal guide, in this example an extrusion profile 15 made of e.g. aluminum, is secured to the ridge beam, e.g. by means of screws or bolts (not shown) extending through holes (not shown) provided in the profile at preselected intervals, e.g. 50 or 60 cm. The ridge tiles 12 in turn are secured to the profile by means of screws, bolts, plugs 16 or the like extending through holes in the ridge tiles 12 and into a slot 17 on the topside of the profile 15. The slot 17 comprises a plurality of longitudinal ribs 17A, best shown in FIG. 6, on one or both of its inner walls to cooperate with thread or protrusions on the screws, bolts, plugs or the like.

In this example, the profile 15 further comprises two channel rails 18, each slidably accommodating an anchor 19. Each anchor comprises a metal strip 20 provided, on one end, with rollers 21 or other bearings to facilitate sliding inside the respective channel rail, and, on the other end, with a means, such as a hook or eye 22, for attaching a anchor rope (not shown). The profile 15 comprises additional channel rails 23, again best shown in FIG. 6, accommodating so-called ventilated ridge elements 24, typically made of relatively thin metal sheet and employed to further shield the space between the tiles and the roof slabs from dirt and water.

The embodiment shown in FIG. 2 is identical to that shown in FIG. 1, with the exception of the ridge beam 8, which is made of metal and forms an integral part of the extrusion profile 15. The profile is secured to the ridge supports 9 by means of bolts 25.

FIGS. 1 and 2 clearly illustrate the efficient use of the space beneath the ridge tiles. Compared to an identical roof without the anchor system, the only visual differences are that in the ridge tiles are slightly higher above the roof tiles on the inclined surface and that the (distal) end of the anchor appears between, in this embodiment, the ridge tiles and the ventilated ridge element. By positioning the guide at a ridge, the anchor, in most instances, will be located relatively high or at least above those parts of the roof where work, such as repairs or maintenance, is likely to be carried out. Also, in one embodiment, the anchor system requires no projecting parts, such as hooks extending between the roof elements.

In general, it is preferred that an anchor rope is permanently attached to the anchor and extends to the lower edge of the inclined surface, such that a worker can attach himself to the rope as soon as he reaches the inclined surface. A weight, such as a rubber ball, is attached at or near the end of the anchor rope to keep it taut.

Figure 3:
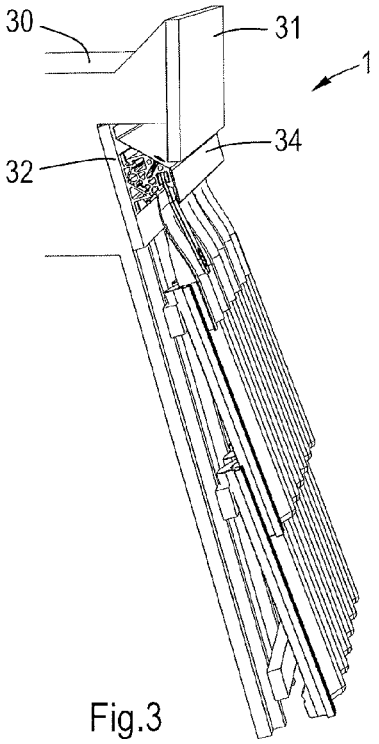
FIGS. 3, 3A and 4 are perspective views of a flat roof with an inclined side and an anchor system.
Figure 4:
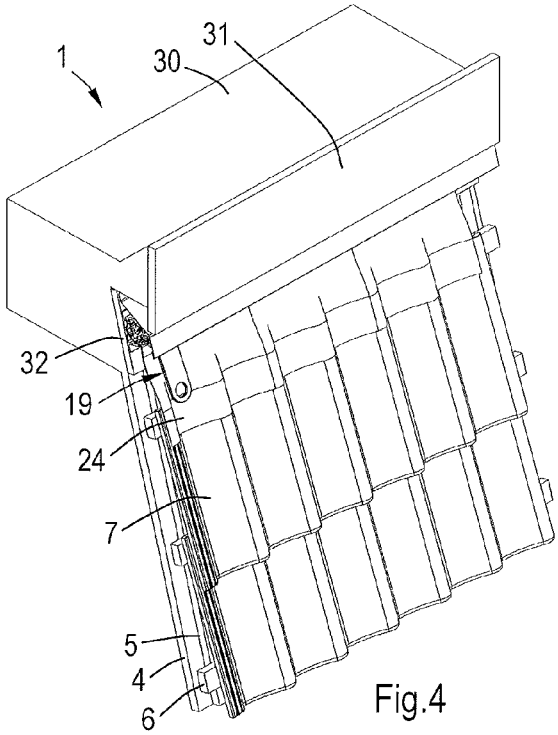
Figure 3A:
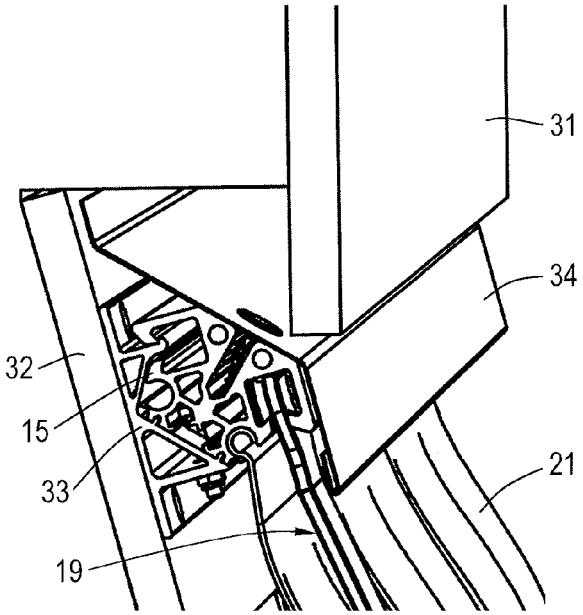

FIGS. 3, 3A and 4 show a flat roof 1 comprising a horizontal top surface and an inclined side as well as an anchor system. The top surface is covered with e.g. bitumen 30 and extends beyond the upper edge of the inclined surface forming a projecting eave 31. The inclined surface is, except for its degree of inclination, essentially identical to that of the embodiment shown in FIGS. 1 and 2 and the various elements are thus denoted by the same numerals. At the transition from the inclined surface to the flat top surface, a sideboard 32 is fixed to a main beam underneath.

The guide of the anchor system, in this example a profile 15 that is identical to that used in the roof shown in FIG. 1, is secured to the sideboard via an additional profile 33 (FIG. 3A). This additional profile, on the one hand, is attached to the sideboard e.g. by means of screws, and, on the other hand, provides features that cooperate with features on the guide, in particular one of the channel rails, to secure the guide to the additional profile. I.e., the additional profile enables the use of a single (main) profile in more than one type of roof.

A cover 34 made of bent metal sheet or plastic is also attached to the sideboard above the anchor system to prevent water from entering the space between the roof tiles and the roof slabs and further protect the sideboard and the system from wind and rain.

Compared to an identical flat roof without the anchor system, the only visual differences are that, in the flat roof, the upper row of tiles on the inclined surface has been replaced by the metal cover (with the anchor system underneath), that a (higher) ventilated ridge element has been used, and that the (distal) end of the anchor appears between, in this embodiment, the cover and the ventilated ridge element.

Figure 5:
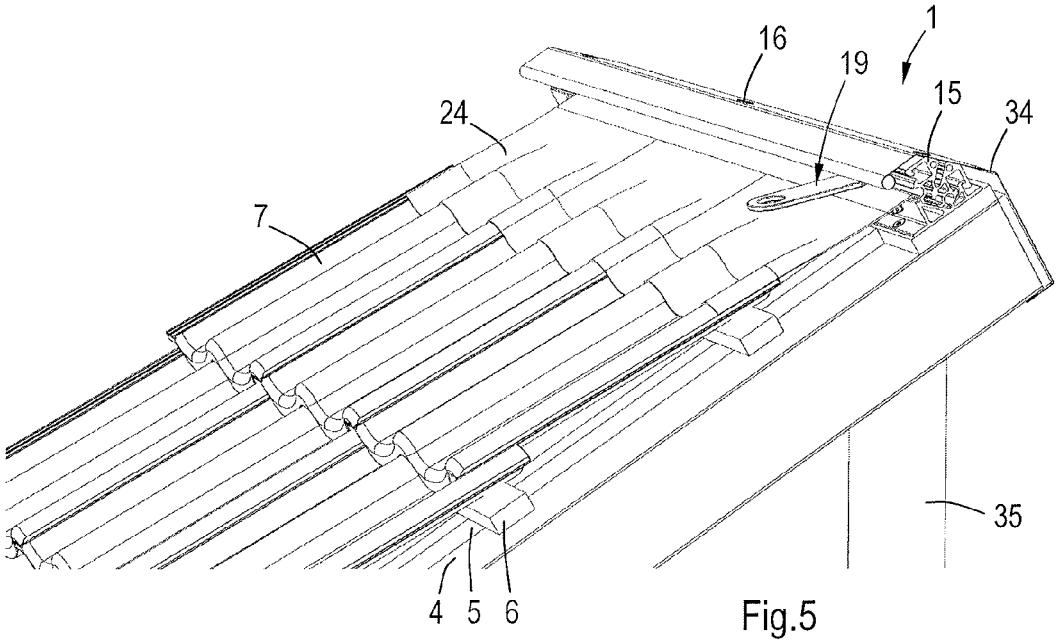
FIGS. 5 and 6 are a perspective view and a cross-section through a pent-roof provided with an anchor system.
Figure 6:
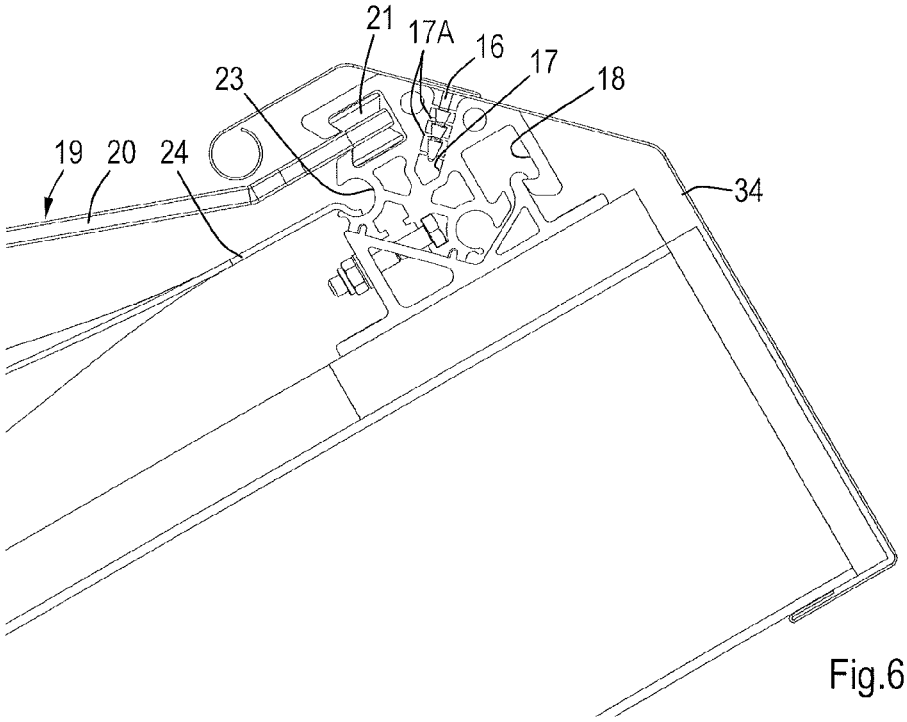

FIGS. 5 and 6 show a pent-roof comprising an inclined surface covered with tiles, a vertical or near vertical wall 35, as well as an anchor system. The inclined surface is, except for its degree of inclination, essentially identical to that of the embodiment shown in FIGS. 3 and 4 and the various elements are denoted by the same numerals. At the transition from the inclined surface to the vertical or near vertical wall, a sideboard is fixed to a main beam underneath and the guide 15 is secured to the sideboard via a further profile, again similar to the embodiment shown in FIGS. 3 and 4. A cover 34 made of bent metal sheet or plastic is attached to the profile 15 by means of plugs 16 and extends over both the eave of the inclined surface edge and the anchor system.

The anchor systems described above fulfill all relevant requirements of EN 795 (Protection against falls from a height. Anchor devices. Requirements and testing.

The invention is not restricted to the above-described embodiments which can be varied in a number of ways within the scope of the claims. For instance, the anchor system can be installed in any type of roof comprising an inclined surface and at least one rim, including e.g. mansard and gambrel roofs.

The invention claimed is:

1. A roof comprising at least:

a first inclined roof surface;

a rim marking a transition to a second roof surface extending horizontally or at a different inclination to the first inclined roof surface;

one or more roof elements attached to and covering the first inclined roof surface and the rim;

at least one anchor configured to attach an anchor rope to, a longitudinal guide comprising at least one rail secured to the roof at the rim and separate from and covered by the roof elements covering the rim, and wherein the at least one anchor is slidably secured to, in, or about the rail;

wherein the roof elements covering the rim are spaced apart from the roof elements covering the first inclined roof surface so as to allow access to the anchor from outside the roof.

2. The roof according to claim 1, wherein the anchor is secured to a structural element of the roof.

3. The roof according to claim 1, wherein the guide comprises at least two rails and an anchor is slidably secured to, in or about each of the rails.

4. The roof according to claim 1, wherein the extrusion profile further defines a ridge beam and/or an element configured to attach a ventilated ridge element to the extrusion profile.

5. The roof according to claim 1, wherein the roof element or elements covering the rim are fixed to the guide.

6. The roof according to claim 1, wherein the anchor extends between the roof elements to outside the roof.

7. The roof according to claim 1, wherein an anchor rope is attached to the anchor and extends to the lower edge of the inclined surface.

8. The roof according to claim 7, wherein a weight is attached to the anchor rope at or near its end.

9. The roof according to claim 1, wherein the first inclined roof surface has a slope of at least 30°, preferably at least 45°.

10. An anchor system to be installed on a roof comprising at least an inclined surface and a rim marking a transition to another surface extending horizontally or at a different inclination, the inclined surface and the rim being covered by one or more roof elements, the system comprising:

an extrusion profile to be secured at the rim of the roof separate from and covered by the one or more roof elements covering the rim, the extrusion profile defining a guiding rail or rails, and further defining a ridge beam and/or an element configured to attach a ventilated ridge element, and one or more anchors to be slidably secured to, in, or about the extrusion profile's guiding rail or rails.

11. The anchor system according to claim 10, wherein the extrusion profile further defines an element configured to fix the roof element or elements so as to cover the rim to the profile.

* * * * *